US005305677A

United States Patent [19]

Kleinguenther et al.

[11] Patent Number: 5,305,677

[45] Date of Patent: Apr. 26, 1994

[54] MUZZLE BRAKE-BULLET STABILIZER

[76] Inventors: Robert A. Kleinguenther, P.O. Box 923, Seguin, Tex. 78155; Glen M. Arnott, 1370 Flaming Oak, New Braunfels, Tex. 78132

[21] Appl. No.: 52,251

[22] Filed: Apr. 23, 1993

[51] Int. Cl.[5] ..... F41A 21/36

[52] U.S. Cl. ..... 89/14.2

[58] Field of Search ..... 89/14.2, 14.3, 14.4

[56] References Cited

U.S. PATENT DOCUMENTS

| | | | |
|---|---|---|---|
| D. 285,238 | 8/1986 | Cellini | D22/108 |
| 3,368,453 | 2/1968 | Shaw | 89/14.3 |
| 3,710,683 | 1/1973 | Kaltmann | 89/14.2 |
| 4,307,652 | 12/1981 | Witt et al. | 89/14.3 |
| 4,893,544 | 1/1990 | Hawley et al. | 89/14.2 |
| 4,930,396 | 6/1990 | Johnson | 89/14.3 |
| 4,945,812 | 8/1990 | Mazzanti | 89/14.3 |
| 4,967,642 | 11/1990 | Mihaita | 89/14.3 |
| 5,020,416 | 6/1991 | Tripp | 89/14.3 |

*Primary Examiner*—David H. Brown

[57] ABSTRACT

The Invention is a muzzle brake-bullet stabilizer, cylindrical in form affixed to the end of a rifle or pistol having internally a primary exhaust stage, a transition stage and nozzle. The primary exhaust stage being adjacent to the muzzle and consisting of a limited number of exhaust port holes drilled radially into progressively smaller internal bores serving as the primary exhaust stage and muzzle brake. A metering orifice being a strait cylindrical bore section of a diameter slightly larger than that of the bullet. The nozzle being conical with the small diameter being that of the metering orifice and increasing slightly thereafter, serving to increase the velocity of the remaining exhaust gases in a manner as to stabilize the bullet in its transition to supersonic velocity of the outside air from that of a negative velocity with respect to the exhaust gases.

1 Claim, 1 Drawing Sheet

MUZZLE BRAKE-BULLET STABILIZER

FIELD OF INVENTION

This invention relates generally to a device for rifles and pistols for improving their accuracy via the controlled exhaust gas flow and additionally obtaining recoil reduction and noise control.

BACKGROUND OF INVENTION

It is generally known that the bullets from rifles and pistols often developed eccentric rotation (or wobble) after leaving the muzzle of the firearm. This phenomenon is generally attributed to the instability of the muzzle itself and/or the action of the exhaust gases on the projectile. It is also generally known that rifles and pistols in the higher calibers produce a substantial recoil on the firearm as a resultant force of the combination velocity/mass relationship of the projectile and propellent. The net result of this interaction destabilizes the muzzle considerably. Much effort has been placed on devices (known as Muzzle Brakes) to diminish this effect, with great success. These devices generally reduce the recoil via a resultant force obtained by the side or rear redirection of the exhaust gases.

This redirection of the gases also redirects the muzzle blast noise toward the shooter, greatly increasing the shooters perception of the blast noise. Some of this noise perception has been reduced by using smaller gas orifices which provide better gas diffusion. However, this is generally at the expense of an increase in recoil over that obtained with a muzzle brake with larger orifices.

A desirable objective is to increase the accuracy of a firearm by directing and controlling various portions of the exhaust gases in a manner as to achieve a balance between projectile stability, recoil, muzzle stability and perceived noise.

THE PRIOR ART

The problems of recoil reduction, muzzle vibration, projectile stabilization, noise and firearm accuracy have all been addressed in part or on the whole with varying degrees of success. The following United States Patents illustrate various devices that claim resolutions in part to the formentioned problems. U.S. Pat. No. Des. 285,238 of Cellini discloses a stabilizer, flash hidder, and recoil reducer. U.S. Pat. No. 4,307,652 of Witt et al., discloses a muzzle guard for firearms for the attachment to the end of a gun barrel. This muzzle guard acts like a break against recoil, lessons the noise and flash of the discharge, also lessons the impact of the gases on the bullet right after the bullet leaves the barrel and allows the escape of the compressed air in front of the bullet. U.S. Pat. No. 4,930,396 of Johnson discloses an improved muzzle brake with internal bore aberrations and small holes to reduce the perceived noise. U.S. Pat. No. 4,945,812 of Mazzanti discloses a muzzle brake and method of making the same of a muzzle brake with circular rows of holes of a tubular construction. U.S. Pat. No. 5,020,416 of Tripp discloses a muzzle brake for firearms encompassing an internal expansion chamber, deflection holes, and a muzzle apparatus for selective direction of muzzle blast.

Heretofore the art suffers from a combination of disadvantages:

(a) Their size renders them impractical for normal application considerations.

(b) They fail to effectively address firearm accuracy.

(c) The basic design fails to address use considerations.

OBJECTIVES AND ADVANTAGES

The objective of this Muzzle brake-bullet stabilizer is to provide practical device for the shooter. In addition, a device that is highly functional. Several of the advantages are:

(a) It enhances the accuracy of a firearm.

(b) It provides a combination of recoil reduction with accuracy enhancement.

(c) The combination of internal features allows for esthetically pleasing external contours.

SUMMARY OF THE INVENTION

It is the object of this invention to provide a muzzle attachment device for firearms that improves accuracy by utilizing exhaust gases to create an improved projectile flight gas/air transition zone, gas deflection for recoil breaking, and stepped gas deflection for perceived noise reduction.

Accordingly, this invention balances the expulsion of the exhaust gases in a manner that allows a portion of the gases to be deflected for recoil reduction and the balance forwarded to a frontal supersonic nozzle creating a stabilizing transition zone for the projectile as it encounters gases with first positive and then negative sonic velocities as it leaves the bore of the barrel.

This device consist, sequentially, of four sections, muzzle attachment, primary exhaust, metering, and supersonic nozzle.

Accordingly, this invention is affixed to the muzzle, has a small number of holes adjacent to the muzzle drilled radially into internal bores of decreasing diameter. These holes being of the size and spacing as to effectively form slots that project at different radial orientation from each other, one row to the next. The internal deflection walls and directional holes connected to each, direct the muzzle blast in a controlled decisive manner. This forms the primary exhaust section.

A metering section lies between the primary exhaust and the supersonic nozzle. This section consist of a bore with a diameter slightly larger than that of the projectile. This section provides a metered restriction as the projectile passes through it. By varying the diameter and length of this section, a balance is achieved between recoil reduction attained by the gases exiting the primary exhaust and the gases exiting the supersonic nozzle for projectile stabilization.

Figure 1:
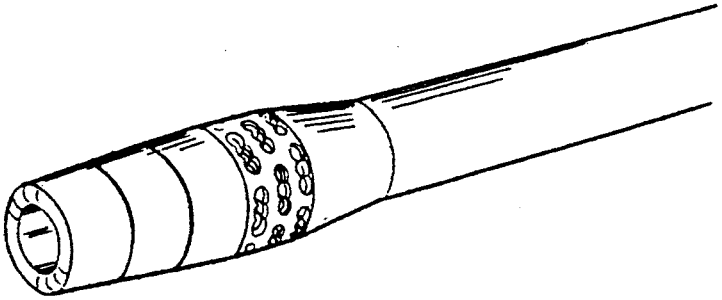
FIG. 1 is a prospective side view of the invention affixed to a muzzle of a firearm.

REFERENCE NUMBERS IN DRAWING 1 barrel
2 barrel bore
4 bore diameter
5 bore diameter
6 bore diameter 7 metering section
8 Supersonic nozzle
9 exhaust ports

DESCRIPTION OF THE PREFERRED EMBODIMENT

The invention is of a construction consisting of a threaded muzzle attachment means, a primary exhaust section, a metering section, and a supersonic nozzle. The material being of steel or other suitable material of sufficient strength, cylindrical in shape with the largest diameter being in the range of twenty to thirty percent larger than that of the muzzle.

On FIG. 1 is an orthographic showing the general appearance of the preferred embodiment with a tapered exterior for and aft of the three rows of holes forming the primary exhaust section.

Figure 2:
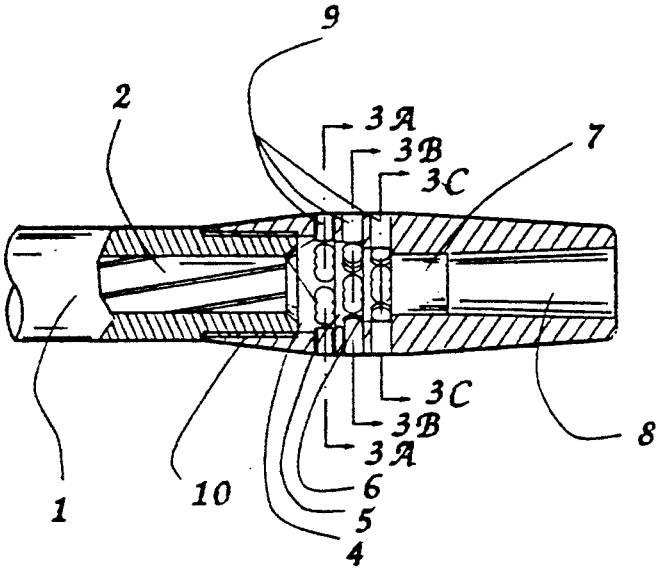
FIG. 2 is a cross sectional view of the preferred embodiment of the invention, shown affixed to the muzzle of a firearm.

FIG. 2 has shown a (1) barrel with a (10) threaded attachment section that is formed with a thread of with a fine pitch and a major diameter slightly smaller than that of the muzzle with a length of slightly less than one quarter the total length of the device. A primary exhaust section formed with three bore diameters (4, 5, and 6) and exhaust ports (9) with a total length which is approximately fifteen percent greater than that of the cylindrical portion of the projectile as measured from the muzzle. The bore diameters (4, 5, and 6) sized with the largest being that of the minor diameter of the threaded section and the others being such that they are a division of the difference in size of the largest bore and the bore diameter of the metering section. Each bore being truncated by rows of radial exhaust ports (9) forming internally stepped deflection walls. The exhaust ports (9) being formed by groups of holes of a size and spacing such that the intersecting diameters will essentially form slots at the outside diameter of the device. A metering section (7) adjacent to the primary exhaust section has a diameter of slight larger than that of the projectile and a length of that of cylindrical portion of same. The supersonic nozzle (8) has a small diameter equal to that of the metering section (7) and diverges with a small angle to the end and has a length of approximately one third the total length of the device.

Figure 3A:
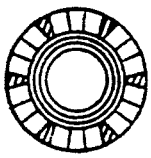
FIGS. 3*a*, 3*b*, and 3*c* are cross sectional views of an optional hole pattern in the primary exhaust section of the invention.
Figure 3B:
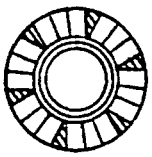
Figure 3C:
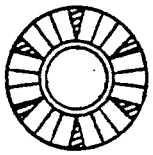

On FIGS. 3*a*, 3*b*, and 3*c* is shown the stepped and rotated position of the exhaust ports relative to each other.

What is claimed is:

1. A muzzle brake-bullet stabilizer comprising:

a cylindrical body of predetermined length having: a muzzle attachment means;

an exhaust chamber of limited length comprised of bores of decreasing diameter, each bore being truncated by and communicating with a plurality of radial exhaust ports forming deflection walls;

a metering orifice, coaxial and communicating with said exhaust chamber, having a diameter slightly larger than that of the projectile;

a supersonic nozzle communicating with said metering orifice and having a minor diameter equal to that of said metering orifice increasing thereafter in size to the end of said cylindrical body;

said exhaust ports being slots in nature formed by the intersection of multiple radial holes; said exhaust ports having a different orientation one to the next.

* * * * *